US010974117B2

(12) United States Patent
Wesig

(10) Patent No.: US 10,974,117 B2
(45) Date of Patent: Apr. 13, 2021

(54) BASKETBALL TRAINING AID

(71) Applicant: Never Ending Defender, LLC, Akron, OH (US)

(72) Inventor: Brandon D. Wesig, Akron, OH (US)

( * ) Notice: Subject to any disclaimer, the term of this patent is extended or adjusted under 35 U.S.C. 154(b) by 0 days.

(21) Appl. No.: 16/696,477

(22) Filed: Nov. 26, 2019

(65) Prior Publication Data

US 2021/0001197 A1 Jan. 7, 2021

Related U.S. Application Data

(60) Provisional application No. 62/870,957, filed on Jul. 5, 2019.

(51) Int. Cl.
*A63B 69/00* (2006.01)

(52) U.S. Cl.
CPC ..... *A63B 69/0071* (2013.01); *A63B 69/0059* (2013.01)

(58) Field of Classification Search
CPC ..... A63B 69/0071; A63B 69/0059
USPC ..... 473/450, 458, 438, 422, 464; D21/788, D21/698
See application file for complete search history.

(56) References Cited

U.S. PATENT DOCUMENTS

D265,493 S * 7/1982 Kringlie ..... D21/701
4,383,685 A * 5/1983 Bishop ..... A63B 69/0071 473/450
4,579,341 A * 4/1986 Furr ..... A63B 69/0071 473/450
5,320,342 A 6/1994 Houck
5,485,993 A 1/1996 Lipsett
5,800,291 A 9/1998 Grover
5,890,985 A 4/1999 Jenney
6,159,111 A 12/2000 Purcell
6,461,256 B1 * 10/2002 Popeck ..... A63B 69/0059 473/450
7,658,689 B2 2/2010 Crook, II
8,152,660 B1 4/2012 Jimenez et al.
8,277,340 B1 10/2012 Devine
D706,888 S * 6/2014 Gideon ..... D21/788
8,852,031 B2 10/2014 Williams, Sr.
9,095,755 B1 8/2015 Hill
2003/0211906 A1 11/2003 Seltzer et al.
2006/0199676 A1 9/2006 Ashbaugh
2012/0115652 A1 5/2012 Young
2017/0312607 A1 11/2017 Moore, Jr.
2018/0111030 A1 4/2018 Blakeney

* cited by examiner

*Primary Examiner* — Mitra Aryanpour
(74) *Attorney, Agent, or Firm* — Emerson, Thomson & Bennett, LLC; Roger D. Emerson

(57) ABSTRACT

A basketball training aid has a harness removably secured to a body of a player. A bumper is retained at a predetermined position in proximity to the body of the player and represents an obstacle to the player, either to the player's field of view or the movement of the player. In this manner, the bumper provides the player with simulated practice of a basketball skill. The bumper is supported by an elongate attachment, which has a first end connected to the bumper and a second end connected to the harness and configured to support the bumper at the predetermined position in proximity to the body of the player.

12 Claims, 13 Drawing Sheets

BASKETBALL TRAINING AID

CROSS-REFERENCE TO RELATED APPLICATIONS

This application claims the benefit of U.S. Provisional Application No. 62/870,957, entitled BASKETBALL TRAINING AID, filed Jul. 5, 2019, which is fully incorporated herein by reference.

I. BACKGROUND OF THE INVENTION

A. Field of Invention

This invention pertains to the field of sports training aids. In particular, the invention pertains to training aids for the sport of basketball, to help a player improve various skills and techniques.

B. Description of the Related Art

It is known in the art to provide basketball training aids. One known type of basketball training aid includes artificial arms that are strapped to the body of a defending player in contending against a player to be trained. These artificial arms provide added height to the defending player and thereby present a greater obstruction to thereby assist the player to be training against taller opponents. However, this type of training aid requires the participation of another player and does not assist a player while practicing alone.

Another known type of basketball training aid includes an artificial hand that is strapped to a player's body and is maintained in a position in front of the player's face. Training aids of this type simulate the hand of a defending player as an obstruction to the player's vision. Such training aids can help a player practice with a limited field of view. However, training aids of this type are limited in that they can only provide one type of skill practice to the player, learning to shoot with an obstruction in front of the face. Such apparatuses cannot enable the player to practice a range of basketball skills.

The present invention provides a basketball training aid with several different types of removable adjustable attachments that can enable a player to practice a range of different basketball skills.

II. SUMMARY OF THE INVENTION

Provided in this disclosure is a basketball training aid having an adjustable harness removably secured to a body of a player. A bumper or shield is retained at a predetermined position in proximity to the body of the player. The bumper represents an obstacle to the player, which can be an obstacle to the player's field of view or the movement of the player. In this manner, the bumper provides the player with a simulated defender while practicing basketball skills.

The bumper or shield is supported by an elongate attachment, which has a first end connected to the bumper and a second end connected to the harness. The elongate attachment is configured to support the bumper at the predetermined position in proximity to the body of the player. A connector assembly is provided having respective mating portions on the harness and the second end of the elongate attachment. These mating portions of the connector assembly are releasable to enable removal of the elongate attachment from the harness.

According to one aspect of the present invention, the basketball training aid is provided to help a player practice a variety of shooting skills against an emulated defender that moves with the player.

According to another aspect of the present invention, the basketball training aid is provided to help a player practice a variety of ball handling skills against an emulated defender that moves with the player.

According to yet another aspect of the present invention, the basketball training aid helps the player preserve the integrity of each skill being practiced by providing an obstacle to overcome.

According to still another aspect of the present invention, the basketball training aid helps the player to maintain good form while practicing the basketball skills.

Still other benefits and advantages of the invention will become apparent to those skilled in the art to which it pertains upon a reading and understanding of the following detailed specification.

BRIEF DESCRIPTION OF THE DRAWINGS

The invention may take physical form in certain parts and arrangement of parts, embodiment of which will be described in detail in this specification and illustrated in the accompanying drawings which form a part hereof and wherein.

IV. DETAILED DESCRIPTION OF THE INVENTION

Figure 1A:
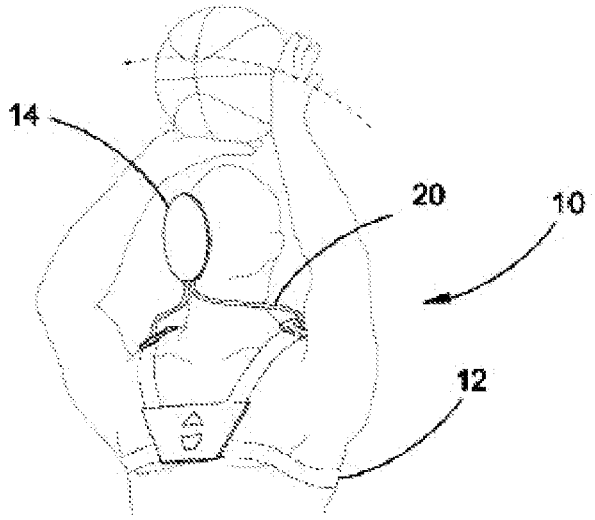
FIGS. 1A, 1B, and 1C are respective front, side, and partial assembly views of an exemplary embodiment of the basketball training aid according to the present invention.
Figure 1B:
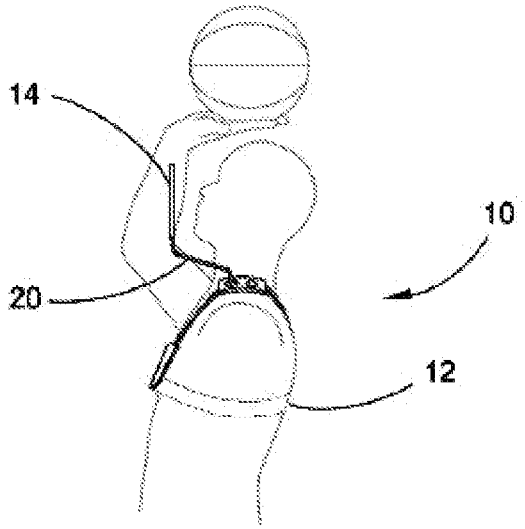

Referring now to the drawings wherein the showings are for purposes of illustrating embodiments of the invention only and not for purposes of limiting the same, FIGS. 1A and 1B show respective front, side, and partial assembly views of an exemplary embodiment of the basketball training aid 10 as worn by a solo player for practicing basketball skills against an emulated defender that moves with the player. The basketball training aid 10 thus helps the player preserve the integrity of each skill being practiced by providing an obstacle.

The basketball training aid 10 includes a harness 12 that is removably secured to a body of the player. A bumper 14 is retained at a predetermined position in proximity to the body of the player. As shown in the exemplary embodiment of FIGS. 1A and 1B, the bumper 14 is retained at a predetermined position in front of the face of the player. But in other alternative embodiments, the bumper 14 can be retained at a variety of different predetermined positions in proximity to the body of the player, as will be described in detail hereinbelow. In all embodiments of the present invention, the bumper 14 represents an obstacle to either the field of view of the player or the movement of the player, in order to provide for simulated practice of a basketball skill against an emulated opponent.

Figure 1C:
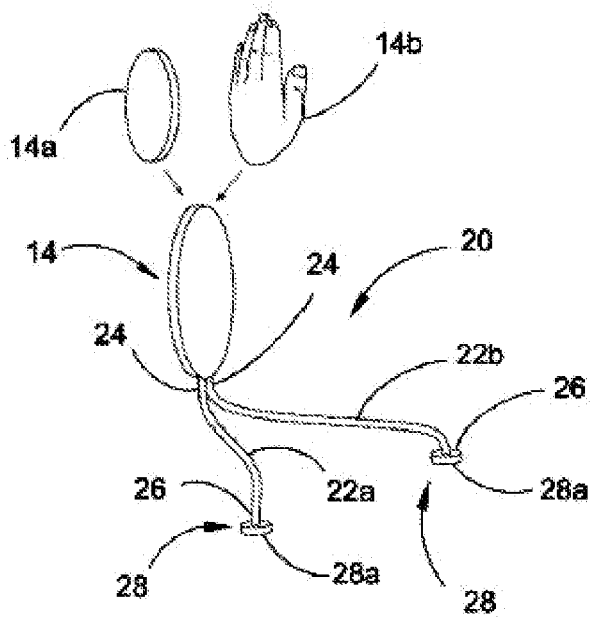

The basketball training aid 10 also includes an elongate attachment 20 configured to support the bumper 14 at the predetermined position in proximity to the body of the player. In the exemplary embodiment, as especially shown in the side view of FIG. 1C, the elongate attachment 20 can include a pair of elongate members 22*a*, 22*b*, each connected to the bumper 14. In the embodiment of FIGS. 1A, 1B and 1C, the pair of elongate members 22*a*, 22*b* can provide dual supports for maintaining the bumper 14 in a stable position at the predetermined position in proximity to the body of the player. However, the elongate attachment 20 can alternatively include a single elongate member or a greater plurality of elongate portions, without departing from the invention.

Each elongate portion 22*a*, 22*b* of the elongate attachment 20 includes a first end 24 connected to the bumper 14 and a second end 26, opposite from the first end 24, which is connected to the harness 12. A connector assembly 28 is provided having respective mating connector portions 28*a* on the second end 26 of the elongate attachment 20 which each mate with respective connector portions connected to the harness 12. These mating connector portions of the connector assembly 28 are releasable to selectively enable removal of the elongate attachment from the harness 12. The connector assembly 28 and the respective mating portions will be discussed in greater detail hereinbelow.

The embodiment of FIGS. 1A, 1B, and 1C relates to a "closeout" hand attachment in which the elongate attachment 20 is configured to hold the bumper 14 at a predetermined position to emulate a "closeout" in which the hand of a defender is held in proximity to the face of the player, to inhibit or block the player's field of view and line of sight for effectively shooting a basket and passing or dribbling the ball. In this manner, the player can simulate the practice the skills of shooting, passing and dribbling while encountering a visual obstruction, as would be experienced in an actual game.

As particularly shown in FIG. 1C, the bumper 14 can be an elliptical-shaped bumper 14*a* or alternatively, an artificial hand 14*b*. The artificial hand 14*b* can be a generic hand shape or it can be taken from a mold of the hand of an actual player. The bumper 14 can also be made of any other desired shape without departing from the invention.

Figure 2A:
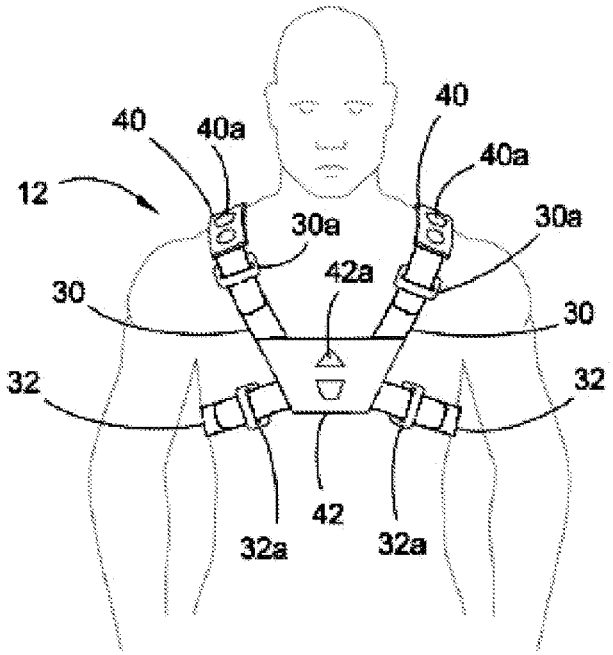
FIGS. 2A and 2B are respective front and back views of a harness for supporting a removable attachment of a basketball training aid according to an embodiment of the present invention.
Figure 2B:
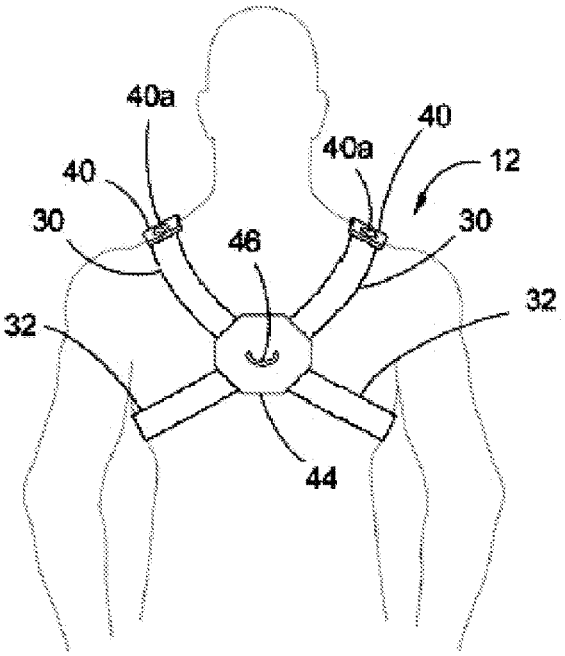

FIGS. 2A and 2B are respective front and back views of the harness 12 according to an embodiment of the present invention. The harness 12 preferably includes a pair of adjustable shoulder straps 30 and a pair of adjustable chest straps 32 that engage the torso of the body of the player. In the preferred embodiment, the shoulder straps 30 are adjustable, two-piece straps that are each retained by a shoulder strap buckle 30*a*. Similarly, the chest straps 32 are also preferably adjustable, two-piece straps that are each also retained by a respective chest strap buckle 32*a*. In this way, the length of the straps 30, 32 can be selectively varied in order to ensure a snug fit of the harness 12 around the torso of the player. The strap ends can be held in place by being removably attached to the strap body. This can be implemented by any suitable attachment applied to adjoining surfaces of the straps such as hook-and-loop fasteners, snaps, velcro, or the like.

As shown in FIGS. 2A and 2B and in the remaining figures, the connector assembly 28 also includes one or more pads that attach to the harness 12. The pads can be shoulder pads 40, used alternatively or in combination with a chest pad 42. The shoulder pads 40 are configured to attach to the shoulder straps 30 so as to lie along the tops of the shoulders of the player. The shoulder pads 40 are preferably configured to slideably engage the shoulder straps 30 in order to be moveably positioned atop the shoulders of the player. Alternatively, the shoulder pads 40 can engage end portions of the shoulder straps 30 so as to be immovable. The chest pad 42 is preferably fixed and engages the ends of the shoulder straps 30 and chest straps 32, to enable the harness 12 to be slipped over the torso and tightened. Alternatively, the chest pad 42 can include one or more buckles for engaging respective parts attached to the ends of the shoulder straps 30 and chest straps 32, to enable quick donning and removal of the harness 12.

The connector assembly 28 includes mating connector portions 40*a* formed on the shoulder pads 40 that engage respective mating connector portions 28*a* on the second end 26 of the elongate attachment 20, as particularly shown in FIG. 1C. Similarly, the connector assembly 28 can also include mating connector portions 42*a* on the chest pad 42 that similarly engage the respective mating connector portions 28*a* on the second end 26 of the elongate attachment 20. As shown in FIGS. 2A and 2B, the mating connector portions 40*a* can have distinctive shapes, such as polygonal, and can also be distinctively colored. The mating connector portions 28*a*, 40*a* of the connector assembly 28 can be of any suitable type of mechanical connector, such as (but not limited to): an insert-and-lock-click arrangement; a screw thread arrangement; or a magnetic arrangement. Any other type of connecting arrangement can also be employed with the connection assembly 28 and the associated mating connector portions 28*a*, 40*a* without departing from the invention.

As especially seen in FIG. 2B, the harness 12 also includes a back portion 44 defining an area over the back of the player where the shoulder straps 30 and the chest straps 32 meet and cross. In one embodiment, the shoulder straps 30 and chest straps 32 can be continuous pieces that cross over in the back, so that a left shoulder strap 30 becomes a right chest strap 32 (and vice versa). In such an embodiment, the back portion 44 can then be configured to slideably engage both of the straps 30, 32 in order to be moveably positioned along the back of the player. Alternatively, each of the shoulder straps 30 and chest straps 32 can terminate at the back portion 44 and be securely connected thereto.

The back portion 44 can include an attachment ring 46 that can enable various accessories to be attached to the harness 12. Such accessories can include a stretch band that can be held by a trainer or secured to a fixed object in order to add resistance to the player, to add resistance to the simulated practice of a basketball skill and thereby increase the strength of the player. This can help the player work through "VSA" skills—vertical, speed and agility—while practicing other skills.

Figure 3:
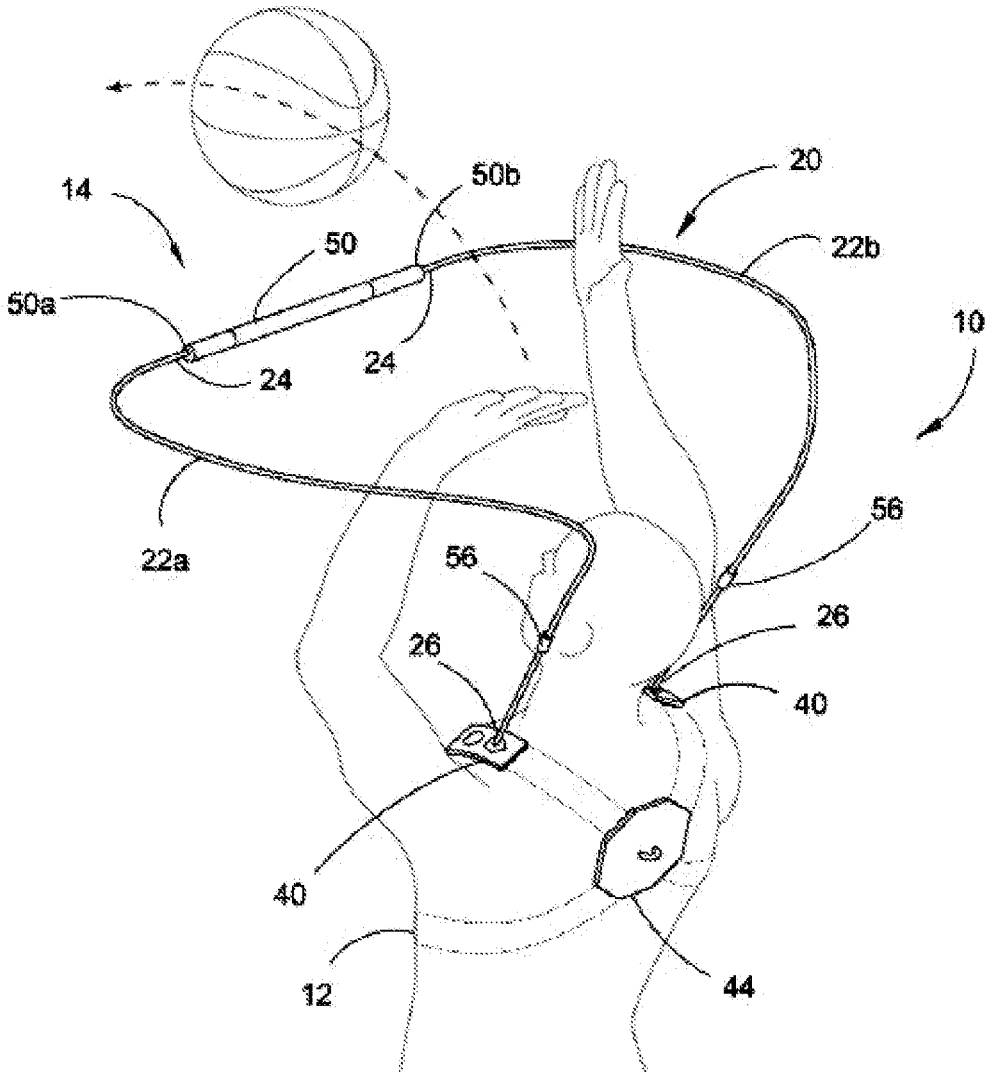
FIG. 3 is a perspective view of an alternative embodiment of the basketball training aid according to the present invention.

FIG. 3 shows an embodiment of the basketball training aid 10 configured to help the player practice "blocking hand" in which the player shoots over an emulated defender attempting to block the shot. In this embodiment the bumper 14 is not a visual bumper, as with the embodiment of FIG. 1, but is rather a physical bumper representing a physical obstacle for blocking the movement of the player. In the embodiment of FIG. 3, the predetermined position of the bumper 14 is in a desired proximity to hands and arms of the player, at a predetermined vertical and horizontal distance with respect to the hands and arms of the player. Specifically, the bumper 14 is retained at about between one and two feet vertically above the head of the player, and at about between one and two feet in front of the player. The bumper 14 defines an obstacle around which the basketball is manipulated in the simulated practice of shooting over the blocking hand of a defender. In addition to helping the player learn to shoot around an obstacle, the bumper also trains the player to maintain the proper form, including maintaining the posture of the back and the proper wrist motion to effectively release the basketball.

The physical bumper 14 of FIG. 3 is preferably a bar bumper 50 in the shape of a horizontal bar having two opposite ends 50*a*, 50*b*. Each of the opposite ends 50*a*, 50*b* are connected to respective first ends 24 of respective first and second elongate members 22*a*, 22*b*, each having respective second ends 26 connected to the harness 12 at the shoulder pads 40.

In this embodiment, the members 22*a*, 22*b* of the elongate attachment 20 preferably engage with a connector assembly on the shoulder pads 40 and each extend vertically upward from the shoulders and horizontally frontward to support the bar bumper 50 at the predetermined position. However, it is to be appreciated that the elongate members 22*a*, 22*b* can be of any suitable configuration in order to retain the physical bumper 50 at the predetermined position.

In the preferred embodiment, the elongate members 22*a*, 22*b* of the elongate attachment 20 are formed as a rigid, tubular member, formed in a curved configuration for retaining the bumper at the predetermined position in proximity to the body of the player. The rigid, tubular member can be of any suitable material, such as a stiff metal wire which can optionally be coated with a rubber material, thereby remaining flexible and bendable. Alternatively, the rigid, tubular member can be formed of a rigid polymer or carbon composite material that retains its shape without being bendable. Any other suitable materials could similarly be adapted without departing from the invention. Moreover, any of these materials of the rigid, tubular member could be suitably adapted for any of the presently disclosed embodiments without departing from the invention.

Figure 4:
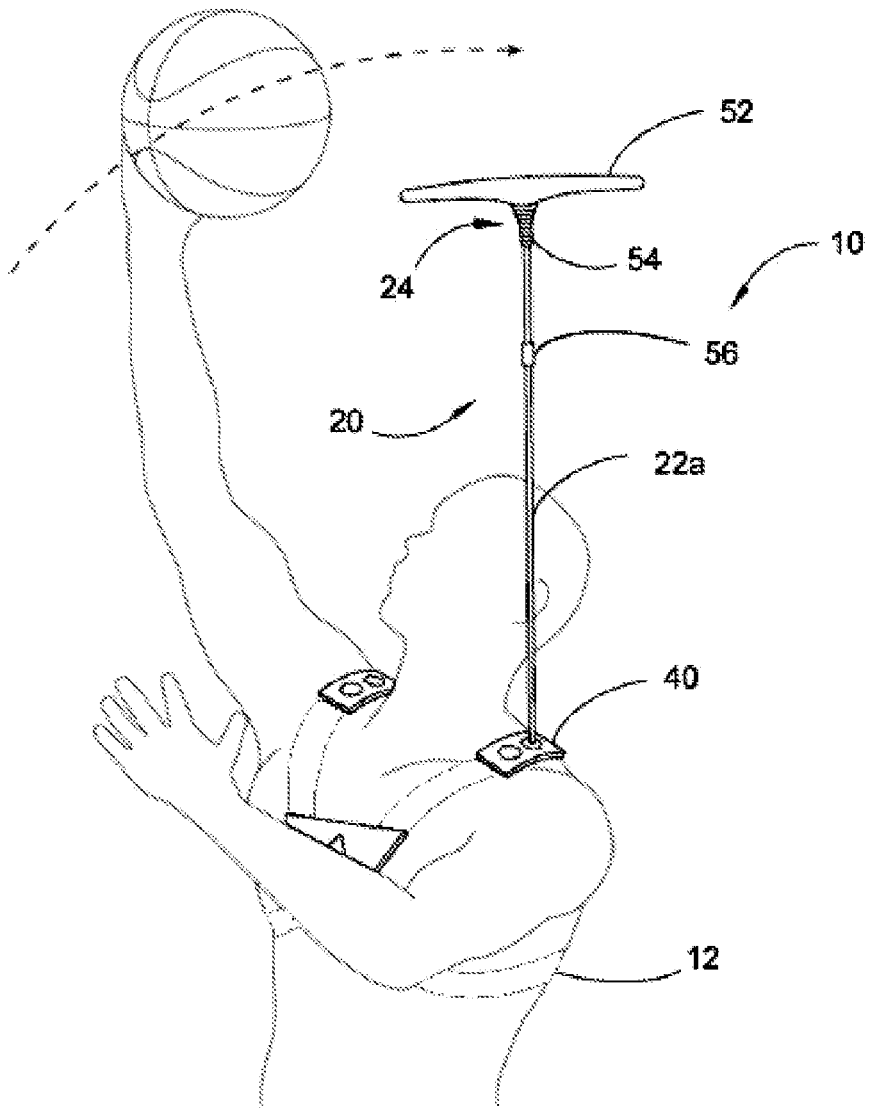
FIG. 4 is an oblique view of another alternative embodiment of the basketball training aid according to the present invention.

FIG. 4 shows an embodiment of the basketball training aid 10 configured to help the player practice a "hook shot" against an emulated defender. In a hook shot, the player's arm swings around and the ball is released over the player's head, so that the ball travels above and beyond the reach of defending players. This embodiment preferably uses a physical bumper in the form of a T-bar 52 with a single connection to the first end 24 of an elongate attachment 20 defined by a single elongate member 22*a*. The single elongate member 22*a* preferably attaches to the shoulder pad 40 and extends vertically upward to a predetermined vertical distance above the head of the player. This T-bar 52 defines a vertical height around which the player must swing in order to practice a hook shot. This embodiment also trains the player to maintain the proper form for a hook shot, including maintaining the posture of the back and the proper arm and hand movements to effectively release the basketball.

The T-bar 52 of the embodiment of FIG. 4 is preferably connected to the first end 24 of the elongate member 22*a* via a flexible connection 54. This flexible connection 54 enables the T-bar 52 to bend during a forceful impact with the player, thereby avoiding injury to the player and damage to the basketball training aid 10. It is to be appreciated that such a flexible connection 54 could be readily adapted for use with any other embodiment of the present invention. Moreover, the flexible connection 54 could also be used in conjunction with or instead of a detachable connection to the elongate attachment 20, in the embodiment of FIG. 4 or any other embodiment of the present invention.

In the embodiment of FIG. 4 and in all other embodiments, the elongate member 22*a* can include a telescoping portion 56 that can be selectively adjusted in length. The telescoping portion 56 incorporates a loosening and tightening portion that can secure the elongate member 22*a* at a selected length. In this way, the telescoping portion 56 can allow a single basketball training aid 10 to be used for helping multiple different players having different heights practice a hook shot. Alternatively, the telescoping portion 56 can allow the basketball training aid 10 to be used for enabling a single player to practice a hook shot at different heights above the player's head. It is to be appreciated that the telescoping portion 56 could similarly be adapted to adjust the heights and other distances of the elongate members 22*a*, 22*b* in any other embodiment of the present invention.

Figure 5A:
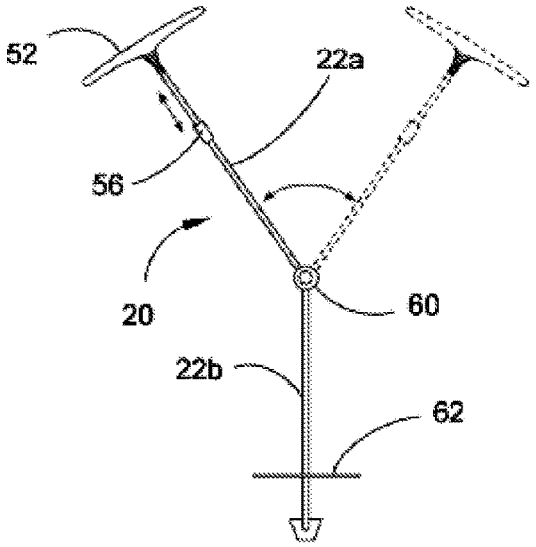
FIGS. 5A and 5B are respective side and oblique views of yet another alternative embodiment of the basketball training aid according to the present invention.
Figure 5B:
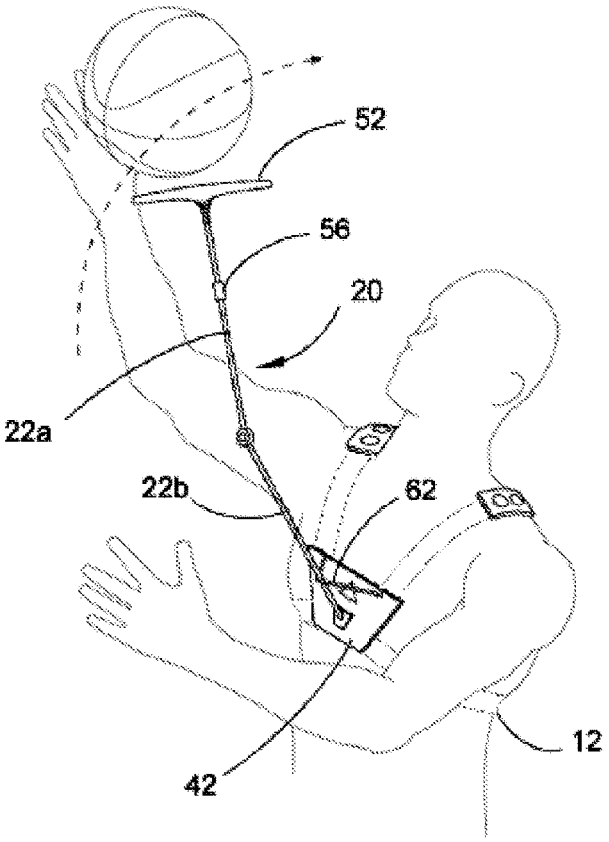

FIGS. 5A and 5B shows an embodiment of the basketball training aid 10 configured to help the player practice a "layup" against an emulated defender. This embodiment preferably uses a physical bumper in the form of a T-bar 52 with a single flexible connection 54 to a single elongate attachment 20 attached to the chest pad 42. The layup embodiment includes an adjustable pivot member 60, set at a selected position along the length of the elongate attachment 20, for selecting a predetermined positioning angle for defining the predetermined position of the T-bar 52. The pivot member 60 divides the elongate attachment 20 into two elongate members 22*a*, 22*b* which pivot with respect to each other and can be set at the predetermined positioning angle. The pivot member 60 can be selectively loosened and tightened in order to select and set the predetermined positioning angle. Moreover, a telescoping portion 56 can be used to selectively vary the length of one or both of the elongate members 22*a*, 22*b*, in order to establish the predetermined position of the T-bar 52. This embodiment further includes a stabilizing element 62 for securely attaching the elongate attachment 20 to the chest pad 42. This stabilizing element 62 can be formed to be received on suitable portions of the chest pad 42. This embodiment trains the player to maintain the proper form for a layup, including maintaining the posture of the back and the proper arm, hand and wrist movements to effectively release the basketball.

Figure 6A:
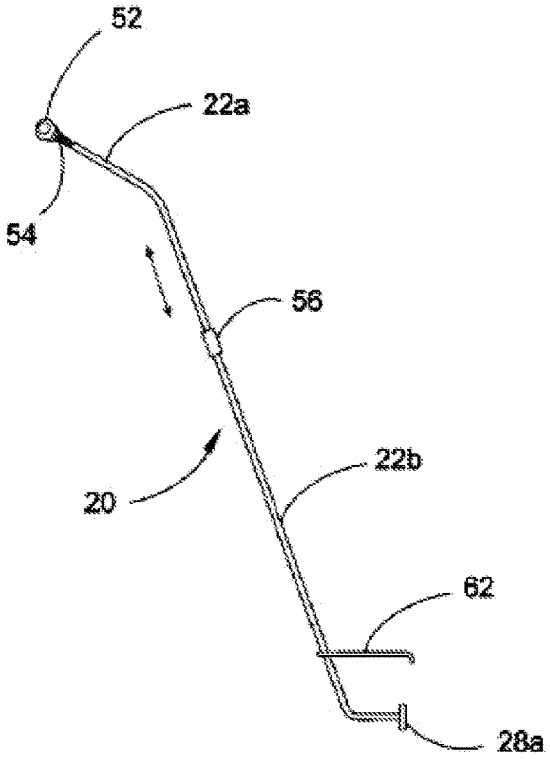
FIGS. 6A and 6B are respective side and oblique views of still another alternative embodiment of the basketball training aid according to the present invention.
Figure 6B:
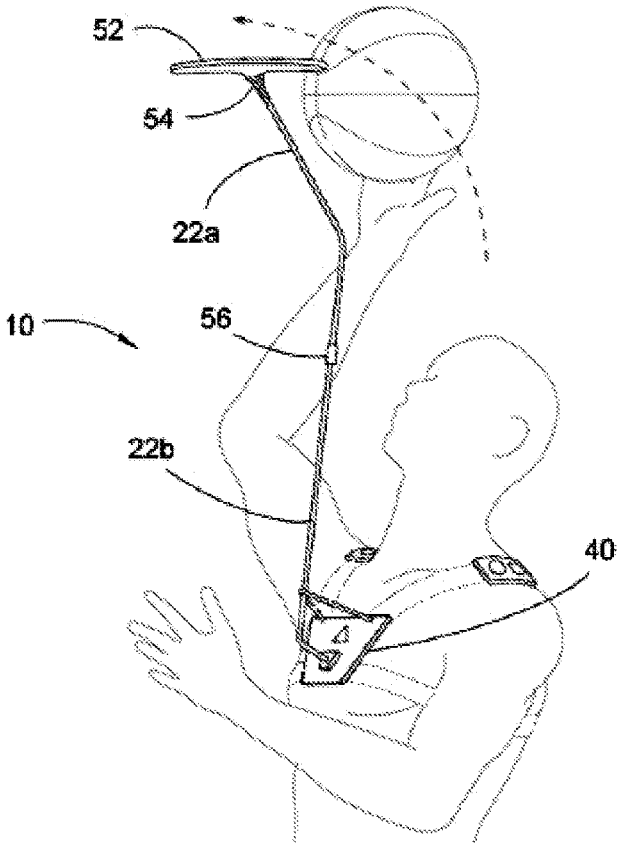

FIGS. 6A and 6B show an embodiment of the basketball training aid 10 configured to help the player practice a "floater" against an emulated defender. This move is similar to a layup but the ball is released earlier and moves in a higher arc. This embodiment preferably also uses a physical bumper in the form of a T-bar 52 with a single flexible connection 54 to a single elongate attachment 20 attached to the chest pad 42. An elongate member 22*a* is bent at a specific angle in order to set the T-bar 52 forward by a specific amount. A telescoping portion 56 can be used to selectively vary the length and thus the position of the elongate member 22*a* in order to establish the predetermined position of the T-bar 52. A stabilizing element 62 is also used in this embodiment for securely attaching the elongate attachment 20 to the chest pad 42. This embodiment also trains the player to maintain the proper form for a floater, including maintaining the posture of the back and the proper arm, hand and wrist movements to effectively release the basketball.

Figure 7:
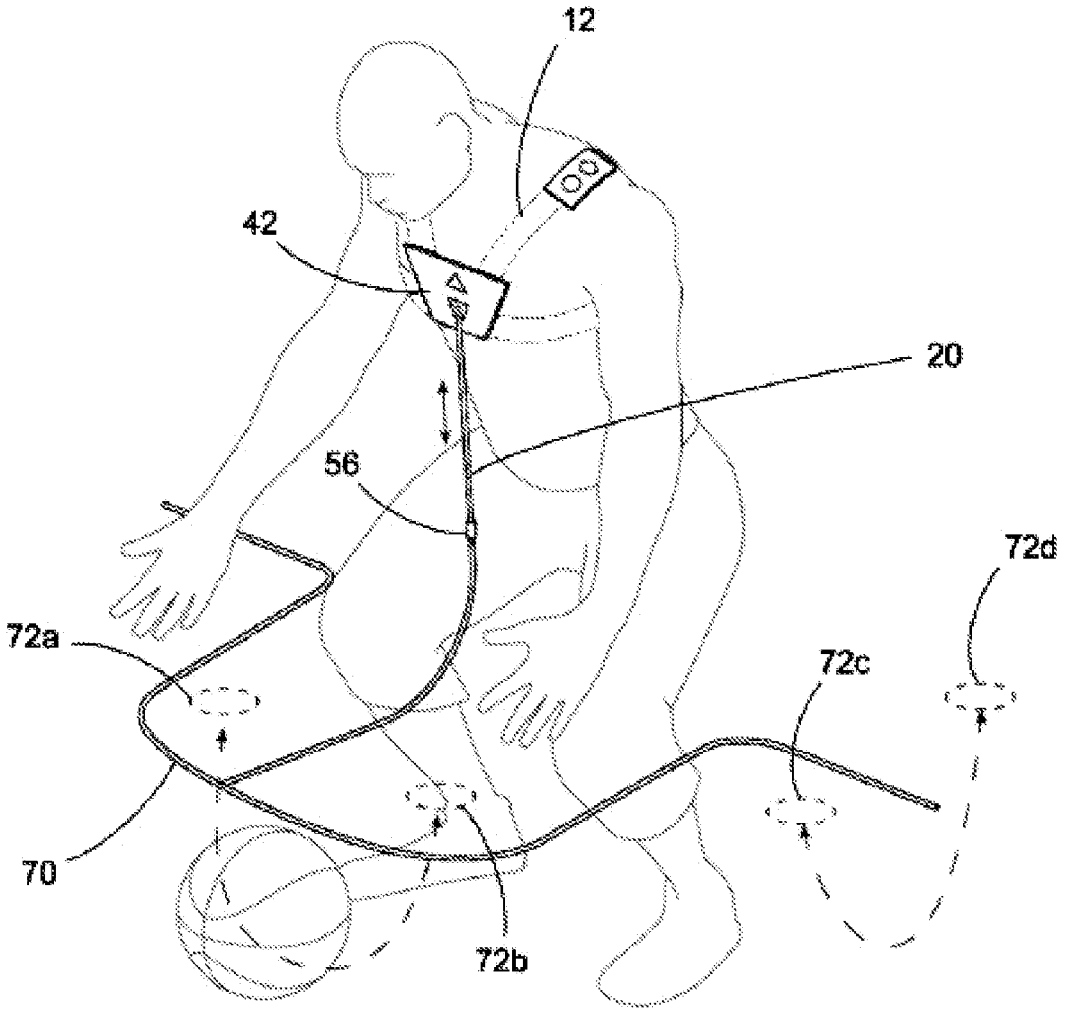
FIG. 7 is a perspective view of a further alternative embodiment of the basketball training aid according to the present invention.

FIG. 7 shows an embodiment of the basketball training aid 10 configured to help the player practice "crossovers" against an emulated defender. This embodiment preferably uses a physical bumper in the form of a zone bar 70 that defines specific zones 72*a*, 72*b*, 72*c*, 72*d* through which the ball can be dribbled. In this manner, the player can practice changing the hands with which the ball is dribbled, where each of the zones 72*a*, 72*b*, 72*c*, 72*d* are targets for which the dribbled ball can be aimed. For example, zones 72*a* and 72*b* are used for front crossover training and zones 72*c* and 72*d* are used for side crossover training.

As shown, the zone bar 70 is a type of elongate member having a specific curved shape used to define the zones around which the ball is to be dribbled. The zone bar 70 is connected through a telescoping portion 56 to a single elongate attachment 20 attached to the chest pad 42. This embodiment also trains the player to maintain the proper form for a crossover, including maintaining the posture of the back and intuitively practicing the arm and hand positions necessary to quickly switch hands while dribbling.

Figure 8A:
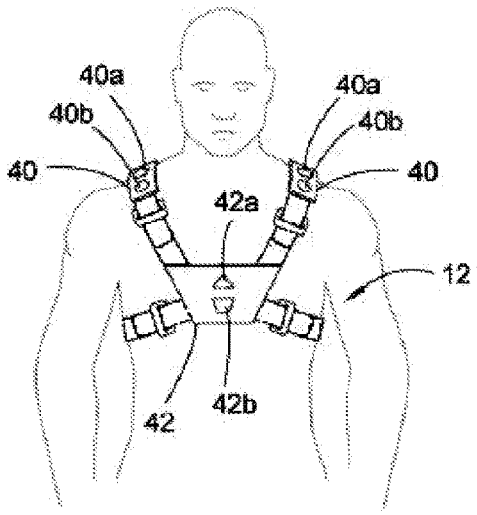
FIGS. 8A and 8B are front views respectively showing the harness and the fully assembled basketball training aid according to another further embodiment of the present invention.
Figure 8B:
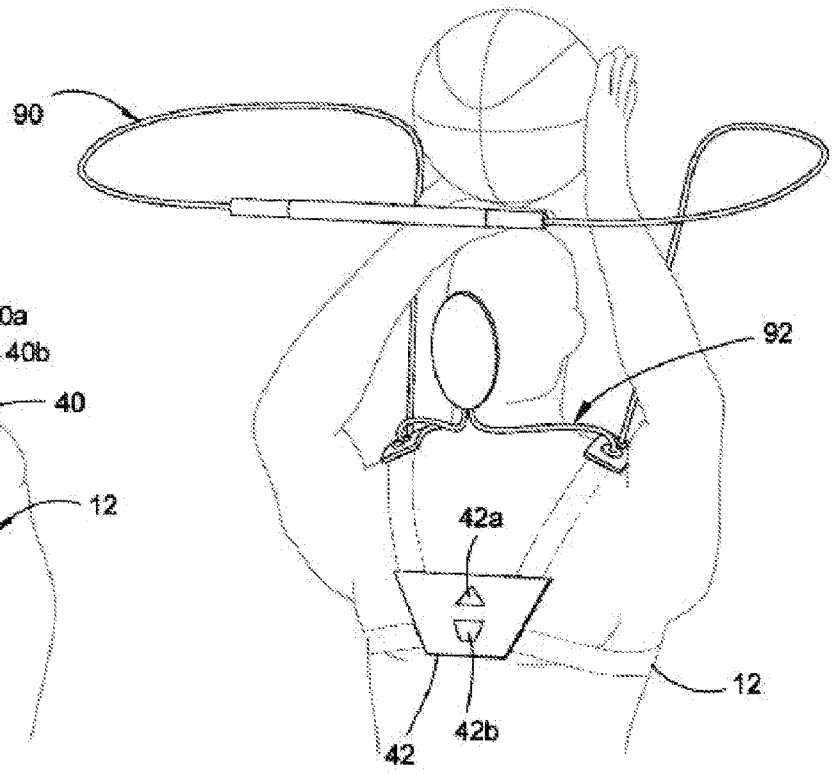
Figure 9A:
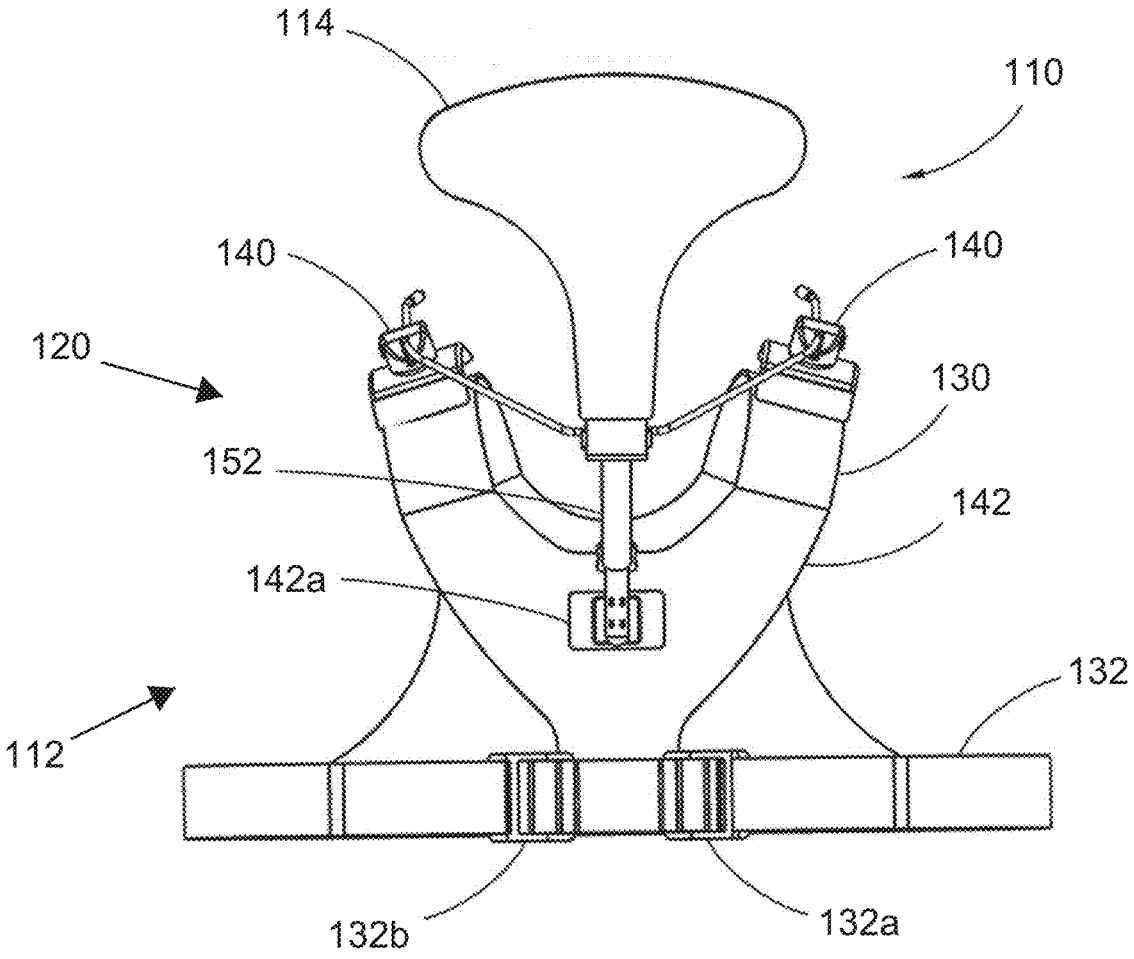
FIGS. 9A, 9B, 9C, 9D, and 9E are respective front, side perspective, side, rear perspective, and rear overhead views showing the harness and the fully assembled basketball training aid according to yet another further embodiment of the present invention.

FIGS. 8A and 8B show an embodiment of the basketball training aid 10 in which more than one type of elongate attachment with respective bumpers are able to be worn on the harness 12 at the same time. As shown in FIG. 9A, the shoulder pads 40 can include more than one mating connector portion 40*a*, 40*b* in order to each connect with a respective mating connector portion 28*a* on an elongate attachment, in the manner disclosed hereinabove. Similarly, the chest pad 42 can include multiple mating connector portions 42*a*, 42*b* to enable a respective number of elongate attachments to connect thereto.

A further alternate embodiment is shown in FIGS. 9A, 9B, 9C, 9D, and 9E. It is to be appreciated that the components disclosed herewith that are similarly named to other components disclosed in the embodiments hereinabove are similar in function and are understood to be incorporated into the present alternate embodiment. FIGS. 9A, 9B, 9C, 9D, and 9E show a basketball training aid 110 having a harness 112 with a bumper 114 in the form of a shield or visor and an elongate attachment 120 composed of several components as will be described in detail hereinbelow.

The harness 112 includes a chest pad in the form of a front panel 142 and a back portion in the form of a back panel 144. The front panel 142 and back panel 144 are preferably formed of a non-stretching, neoprene-based fabric material of the type sold by Macro International Co. The front panel 142 includes a first buckle 132*a* and a second buckle 132*b* attached thereto so that the buckles 132*a*, 132*b* are formed as a single integral piece with the front panel 142. The buckles 132*a*, 132*b* are of a "slide" type to each slidably engage a respective chest strap or torso strap 132, which are both integrally formed to connect to and extend from the back panel 144. The respective pair of torso straps 132 are each looped within the buckles 132*a*, 132*b* and held securely thereto.

The torso straps 132 are preferably formed of a non-stretching, machine-washable, neoprene-based fabric material, also sold by Macro International Co., having portions with Velcro (hook and loop fastener) surfaces. In this manner, the loose ends of the straps 132 can be laid against the sides of the straps 132, as especially shown in FIG. 9C. The loose ends include a portion having an interior "hook" surface of the strap 132 while the engaging a "loop" surface of the strap 132. In this manner, the "hook" surface of the loose end is secured by contact with the "loop" surface, thereby preventing the loose ends of the straps 132 from movement during use.

The harness 112 includes a pair of shoulder straps 130 that are each connected to the front panel 142 and the back panel 144. The shoulder straps 130 are configured to extend between the respective panels 142, 144 and are formed as a single integral piece with the respective panels 142, 144. The shoulder straps 130 are also formed of the same non-stretching, neoprene-based fabric material as the torso straps 132. Each of the shoulder straps 130 also include Velcro "hook and loop fastener" portions for mating with and securely retaining shoulder pads in the form of a pair of shoulder attachment points 140.

Each of the shoulder attachment points 140 include an underside 162 also having a respective mating hook and loop surface for engaging with the corresponding surfaces of the shoulder straps 130. As shown especially in FIGS. 9B, 9C, and 9D, the shoulder attachment points 140 can selectively come away from the shoulder straps 130 when the hook and loop surface on the underside 162 is removed by the user from the shoulder straps 130.

The elongate attachment 120 in accordance with the embodiment of FIGS. 9A, 9B, 9C, 9D, and 9E will now be described in detail herewith. As with the other embodiments of the present invention discussed hereinabove, the elongate attachment 120 securely supports the bumper or visor 114. As depicted in FIG. 9C, the elongate attachment 120 includes a height adjustment rail having a base member 150 and an extending member 152. The extending member 152 is connected to a rotational adjustment mechanism 154, which is turn connected to a visor height adjustment mechanism 156. The rotational adjustment mechanism 154 is also connected to a pair of elongate members 120*a*, which are in turn respectively connected to the shoulder attachment points 140.

Figure 9B:
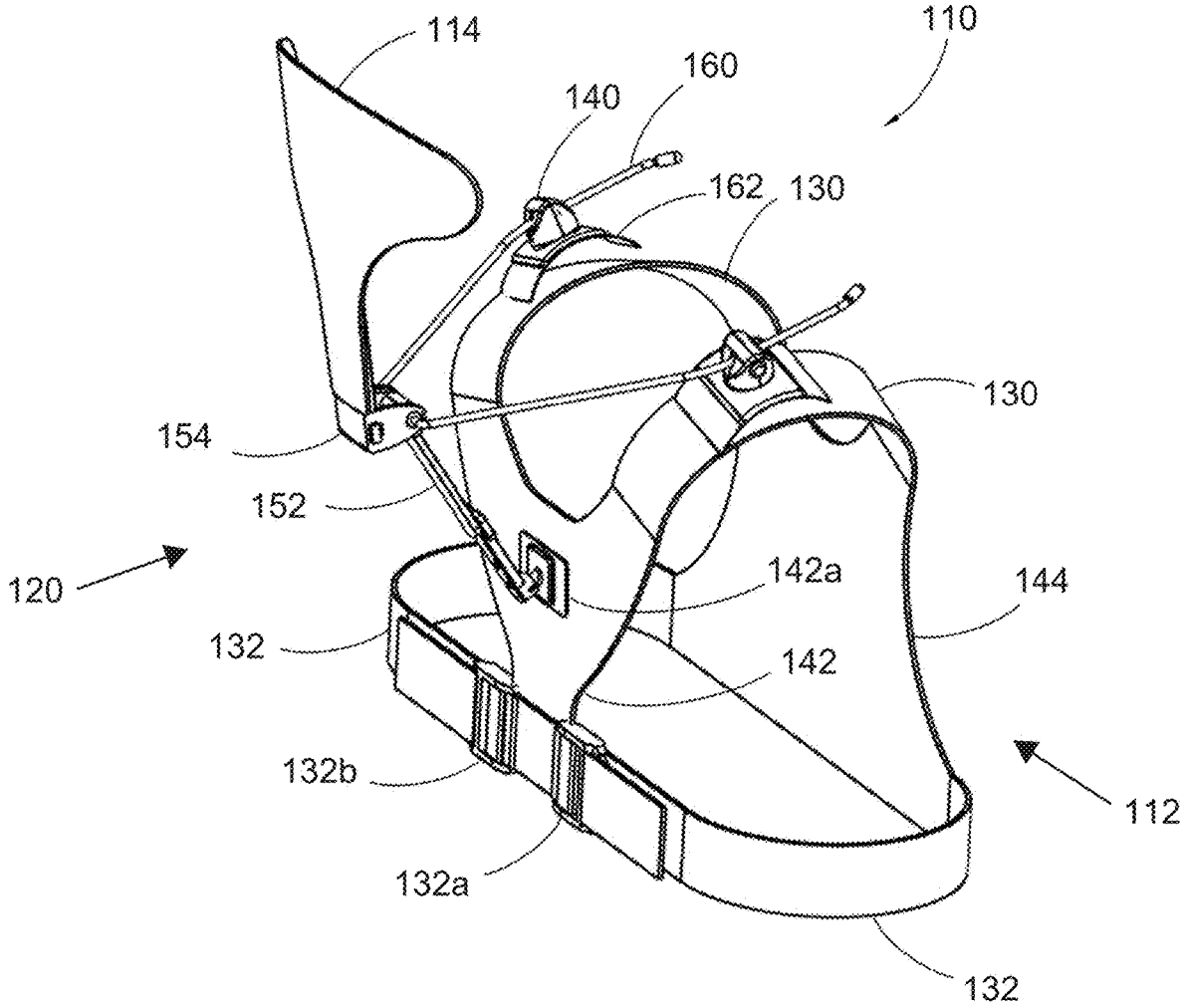
Figure 9C:
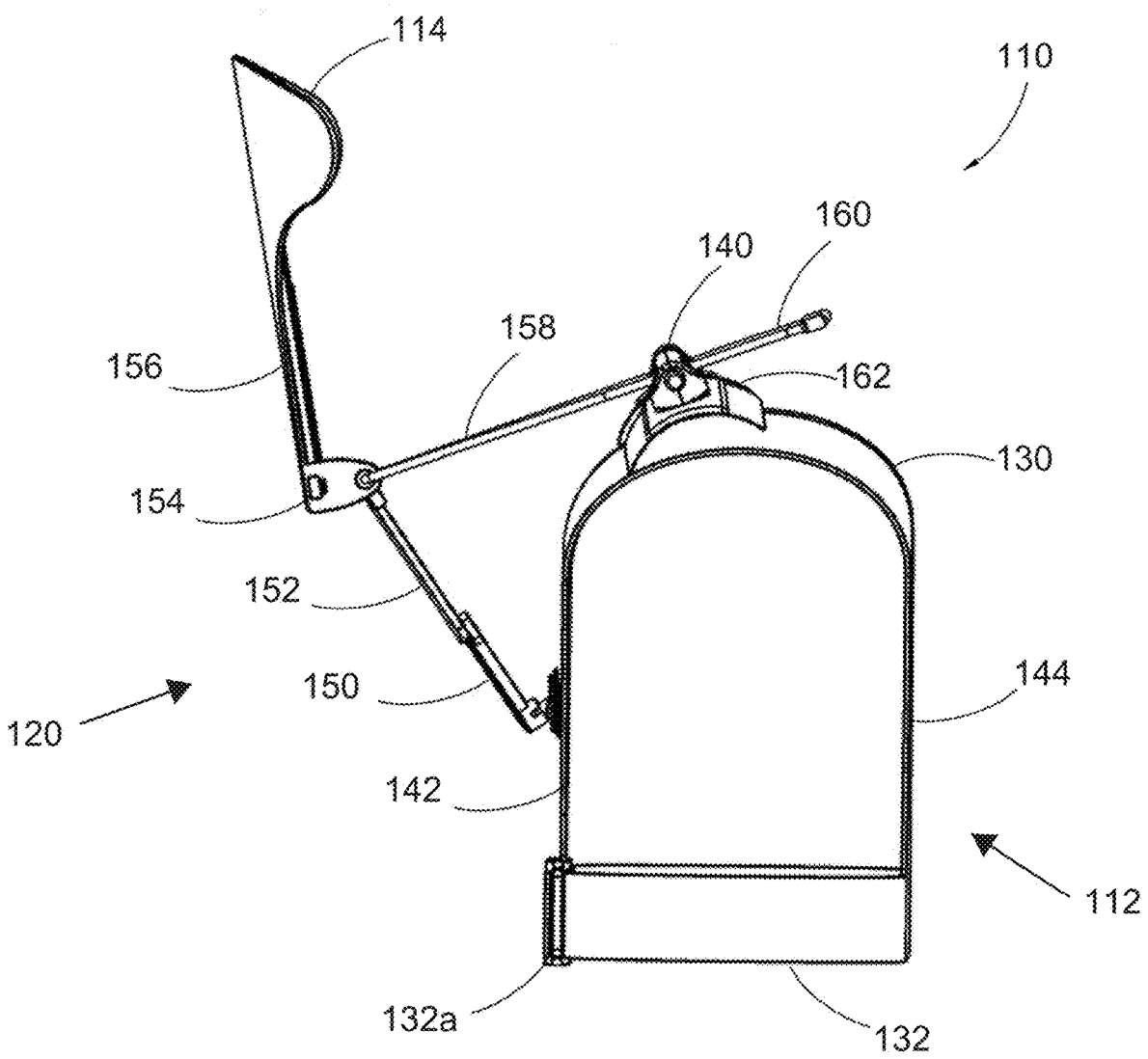

As shown in FIG. 9B, the base member 150 of the height adjustment rail is connected to the front panel 142 with a mating connector portion in the form of a chest attachment point 142*a*. The chest attachment point 142*a* includes a hook and loop surface that securely engages a mating hook and loop surface on the front panel 142. The base member 150 includes an end portion having a ball end (not shown). The ball end sits behind the chest attachment point 142*a* to be retained snugly against the front panel 142. In this manner, the ball end can freely turn and rock back and forth, thereby enabling full 360 degrees of freedom of rotational movement of the base member 150 in all directions. In this way, the height adjustment rail supporting the visor 114 can be tilted at any desired pitch angle toward or away from the player wearing the harness 112.

The base member 150 is slidably connected to the extending member 152. In the preferred embodiment, the extending member 152 is formed to have a U-shaped trough which receives and engages the outside of the base member 150. The base member 150 preferably includes a mechanical detent (not shown) which includes a mechanical spring that cooperates with a button to be manually pinched by a user.

Upon pinching the detent, the spring is released which enables the extending member 152 to slide vertically along the base member 150.

The mechanical detent engages with a series of notches (not shown) formed inside the extending member to provide a plurality of engagement positions. In the preferred embodiment, there are five locations separated by a half-inch. In this manner, the extending member 152 can be extended to increase the length of the height adjustment rail and thus the height of the visor 114 with respect to the face of the player, thereby being adjustably customizable for a variety of different users. The pinch adjustment feature is actuated by finger strength, thereby enabling the height of the visor 114 to be easily selected by users of all ages. The base member 150 and extending member 152 are preferably formed of steel or other suitable metal.

The rotational adjustment mechanism 154 connects to the pair of elongate members 120*a*, one on each side, each of which are in turn respectively connected to a respective shoulder attachment point 140 on each shoulder of the player. In this manner, the elongate members 120*a* provide support and stability to the entire elongate attachment 120. The elongate members 120*a* slide through openings in the respective shoulder attachment points 140. The shoulder attachment points 140 also preferably include pinch-adjustable detents (not shown) which internally grip and release the respective elongate members 120*a*, allowing their length to be varied thereby. The shoulder attachment points 140 include a rotating structure (not shown) and a tilting structure for back and forth rocking movement to accommodate players of different sizes, having different shoulder spans. The shoulder attachment points 140 are preferably formed of nylon or other suitably durable plastic material.

The elongate members 120*a* each include a guide rail 160 at the ends of each elongate member 120*a*. As the elongate member 120*a* is moved back and forth to adjust the length, the guide rail 160 slides inside the shoulder attachment point 140, so that a selected point along the guide rail 160 is gripped by the shoulder attachment point 140, thereby defining the length of the elongate member 120*a*.

A bent portion of the elongate member 120*a* defines the limit of travel of the guide rail 160, so that the bent portion can abut the shoulder attachment point 140 when the guide rail 160 is pulled to the limit. In this manner, the guide rail 160 limits the forward-to-backward placement of the ball end of the base member 150, which in turn defines and limits the pivot angle of entire elongate attachment 120 and thus the distance of the visor 114 from the face of the player. In the preferred embodiment, the lateral movement distance of the guide rail 160 enables a pivot angle of about 45 degrees along an axis of the ball end of the base member 150 between the visor and the body of the player. The elongate members 120*a* are preferably formed of steel or other suitably rigid material.

The rotational adjustment mechanism 154 enables forward and backward tilt of the visor 114, thereby further defining the distance of the visor 114 from the face of the player. The rotational adjustment mechanism 154 preferably includes a rachet structure (not shown) which preferably enables a plurality of positions of rotational adjustment. In the preferred embodiment, the rotational adjustment mechanism 154 enables five different positions of rotational adjustment each separated by 10 degrees, enabling 50 degrees of forward and backward tilt along the axis of the rotational adjustment mechanism 154.

Figure 9D:
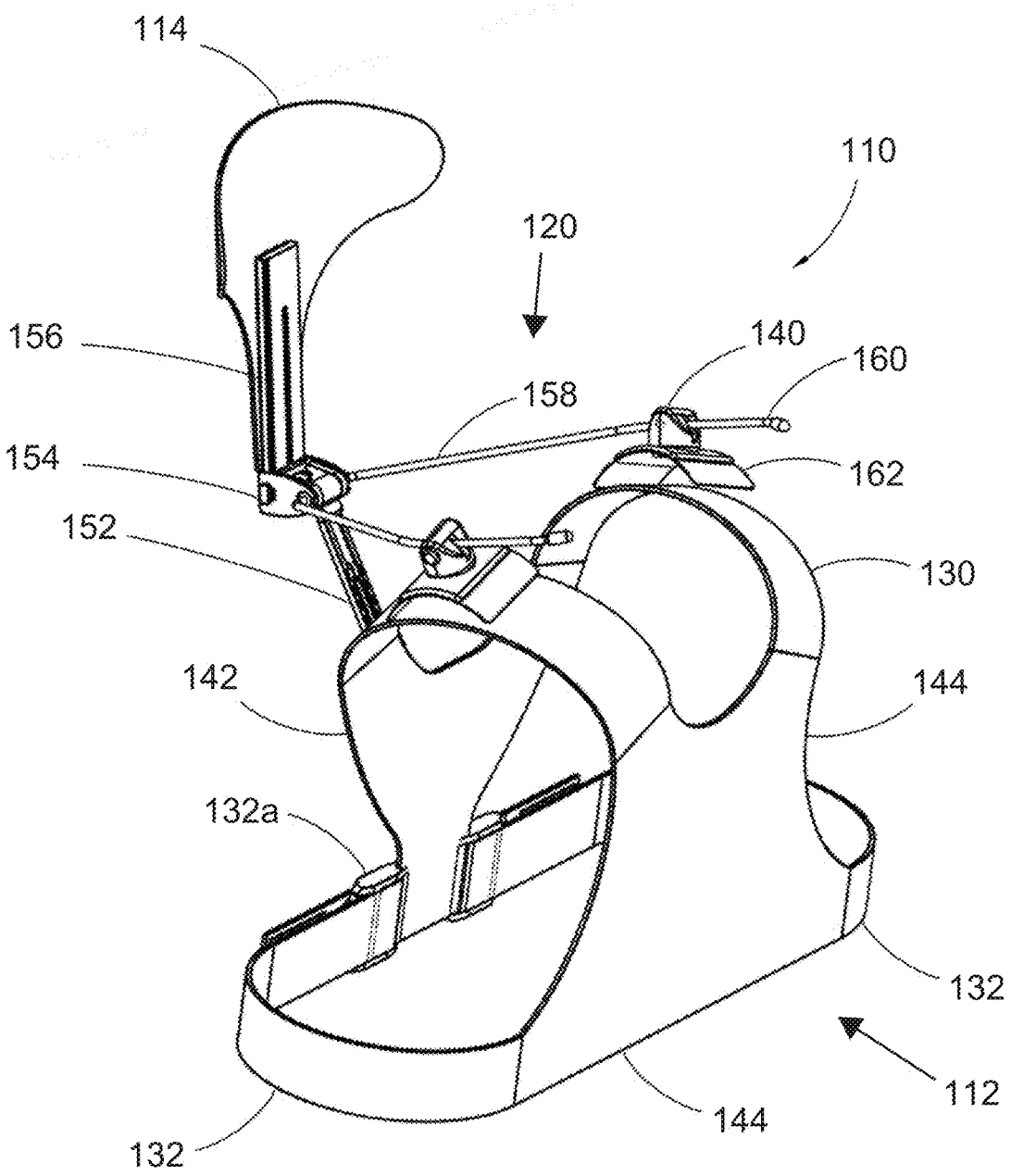
Figure 9E:
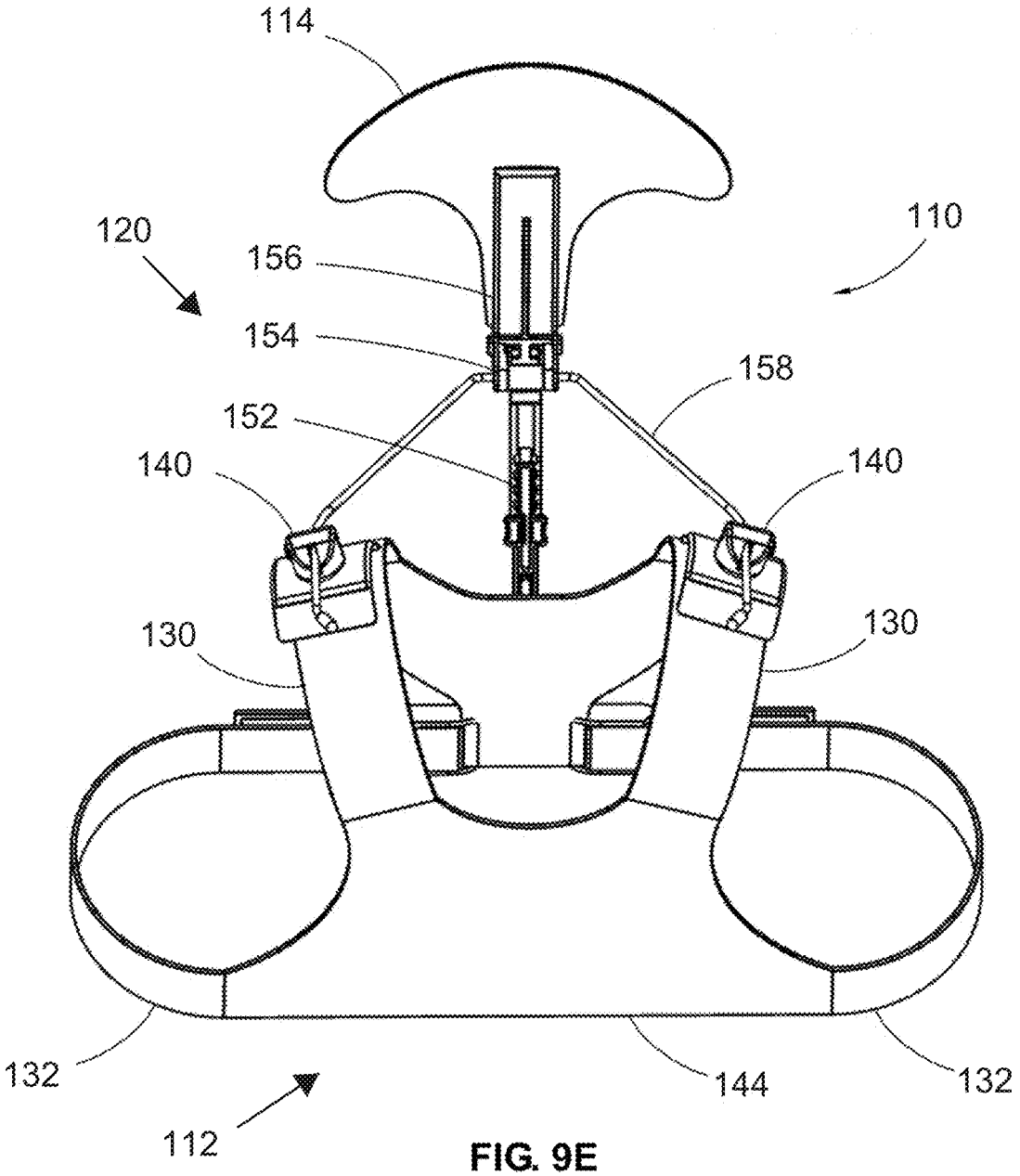

As particularly shown in FIG. 9D, a visor height adjustment mechanism 156 is a second height adjustment mechanism, connected to the rotational adjustment mechanism 154, that enables the height of the visor 114 to be selected. The visor height adjustment mechanism 156 also includes a spring-loaded, pinch-adjustable detent (not shown) for enabling the height of the visor height adjustment mechanism 156 to be varied. A plurality of different height adjustments can thus be implemented. In the preferred embodiment, seven different height adjustment levels can be selected, each separated by a half-inch.

The height and angle adjustments enable the present basketball training aid 110 to be custom sized and fitted for players in a wide range of shapes and sizes. The height and angle adjustments also enable a player to train for different basketball skills. For example, one type of visor placement blocking the front of the face can help a player train for an obstructing opponent. A different visor placement which is tilted downward can block the view of the ball and help the player practice ball handling skills such as dribbling and switching hands without seeing the ball.

As depicted in the FIGS. 9A, 9B, 9C, 9D, the visor 114 preferably has a concave elliptical shape with the concave surface surrounding the face of the player. It has been found through experience that a visor 114 having a rounded, concave shape gives the player a better perception of a blocked view and greater portion of blocking of the visual field. As depicted, the visor 114 is about 9 inches across and having a concavity corresponding to about 100 degrees of a cylinder about 10 inches in diameter. The surfaces are rounded to remove any pointed edges and enhance the perception of safety. Also, the widest portion of the visor 114 is near the player's eyes but the visor 114 is tapered in the lower face area to not obstruct the mouth and trap heat or inhibit a player's breathing.

The embodiments have been described, hereinabove. It will be apparent to those skilled in the art that the above methods and apparatuses may incorporate changes and modifications without departing from the general scope of this invention. It is intended to include all such modifications and alterations in so far as they come within the scope of the appended claims or the equivalents thereof.

Having thus described the invention, it is now claimed:

1. A basketball training device, comprising:

a harness adjustably secured to a body of a player;

a visor retained at a predetermined position in proximity to a face of the player, the visor representing a visual obstacle for blocking a field of view of the player, for simulated practice of basketball skills with visual obstruction; and an elongate attachment connecting the visor to the harness, the elongate attachment configured to adjustably support the visor at the predetermined position in proximity to the face of the player, wherein the elongate attachment comprises:

a height adjustment rail, movably connected to a front panel of the harness, for selectively varying a height of the visor;

a rotational adjustment mechanism, connecting the height adjustment rail to the visor, for selectively enabling forward and backward tilt of the visor, thereby defining a distance of the visor from the face of the player;

a pair of elongate members, each connected to the rotational adjustment mechanism, and each in turn respectively connected to a pair of respective shoulder attachment points on the harness, to provide support and stability to the elongate attachment.

2. The basketball training device of claim 1, wherein each of the elongate members includes a selectively adjustable guide rail for varying the forward-to-backward placement of the elongate attachment, thereby varying a pivot angle for the height adjustment rail and thus the distance of the visor from the face of the player.

3. The basketball training device of claim 1, wherein the elongate attachment further comprises a visor height adjustment mechanism, connected to the rotational adjustment mechanism, for further selectively varying the height of the visor.

4. The basketball training device of claim 1, wherein the harness comprises a front panel and a back panel, wherein the front panel includes a first buckle and a second buckle attached thereto so that the first and second buckles are formed as a single integral piece with the front panel, wherein the first and second buckles slidably engage a respective first and second torso strap, both integrally formed to connect to and extend from the back panel.

5. The basketball training device of claim 4, wherein the harness further comprises a pair of shoulder straps that are each connected to the front panel and the back panel, wherein the shoulder straps are configured to extend between the respective panels and are formed as a single integral piece with the respective panels.

6. The basketball training device of claim 5, wherein each of the pair of shoulder straps respectively securely retain the shoulder attachment points.

7. The basketball training device of claim 2, wherein each of the elongate members comprise a bent portion that defines the limit of travel of each guide rail, so that the bent portion abuts the shoulder attachment point when the guide rail is pulled to a limit, such that the guide rail defines and limits a distance of the visor from the face of the player.

8. The basketball training device of claim 1, wherein the visor has an elliptical shape with a concave surface surrounding the face of the player.

9. A basketball training device, comprising:

a harness adjustably secured to a body of a player;

a visor retained at a predetermined position in proximity to a face of the player, the visor representing a visual obstacle for blocking a field of view of the player, for simulated practice of basketball skills with visual obstruction; and an elongate attachment connecting the visor to the harness, the elongate attachment configured to adjustably support the visor at the predetermined position in proximity to the face of the player, wherein the elongate attachment comprises:

a height adjustment rail, movably connected to a front panel of the harness, for selectively varying a height of the visor, wherein the height adjustment rail further comprises a base member, moveably connected to the front panel of the harness, and an extending member, wherein the base member is slidably connected to the extending member so that the extending member is extended to increase the length of the height adjustment rail and thus the height of the visor with respect to the face of the player.

10. The basketball training device of claim 9, wherein the height adjustment rail further comprises a base member, moveably connected to the front panel of the harness, and an extending member, wherein the base member is slidably connected to the extending member so that the extending member is extended to increase the length of the height adjustment rail and thus the height of the visor with respect to the face of the player.

11. The basketball training device of claim 9, wherein the visor has an elliptical shape with a concave surface surrounding the face of the player.

12. The basketball training device of claim 9, wherein the elongate attachment further comprises a pair of elongate members, each connected to the rotational adjustment mechanism, and each in turn respectively connected to a respective shoulder attachment point on the harness, to provide support and stability to the elongate attachment, each of the elongate members including a selectively adjustable guide rail for varying the forward-to-backward placement of the elongate attachment, thereby varying a pivot angle for the height adjustment rail and thus the distance of the visor from the face of the player.

* * * * *